US010423099B1

(12) United States Patent
Cahill et al.

(10) Patent No.: US 10,423,099 B1
(45) Date of Patent: Sep. 24, 2019

(54) USER STRIPPING MECHANISM WITH PROTRUSION

(71) Applicant: Eastman Kodak Company, Rochester, NY (US)

(72) Inventors: David F. Cahill, Rochester, NY (US); Robert D. Bobo, Ontario, NY (US); Mark H. Allen, Brockport, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 16/153,915

(22) Filed: Oct. 8, 2018

(51) Int. Cl.
*G03G 15/20* (2006.01)
*G03G 15/00* (2006.01)

(52) U.S. Cl.
CPC ..... *G03G 15/2028* (2013.01); *G03G 15/6532* (2013.01)

(58) Field of Classification Search
CPC ..... G03G 15/2028; G03G 15/6532; B65H 29/54; B65H 29/56
See application file for complete search history.

(56) References Cited

U.S. PATENT DOCUMENTS 4,168,902 A * 9/1979 Golz ..... B65H 29/56 399/399
2002/0164172 A1* 11/2002 Tsubaki ..... G03G 15/2028 399/45
2009/0180819 A1* 7/2009 Rasch ..... G03G 15/2028 399/323
2010/0215413 A1* 8/2010 Nakajima ..... G03G 15/2028 399/323
2011/0097121 A1* 4/2011 Yamamoto ..... G03G 15/2028 399/323
2013/0313774 A1* 11/2013 Nishi ..... B65H 29/56 271/307
2014/0050511 A1* 2/2014 Mikutsu ..... G03G 15/2028 399/323
2015/0355583 A1* 12/2015 Kondo ..... G03G 15/2028 399/323

* cited by examiner

*Primary Examiner* — Sophia S Chen
(74) *Attorney, Agent, or Firm* — Kevin E. Spaulding

(57) ABSTRACT

A fuser apparatus includes first and second rollers in nip relation to transport a receiver member therebetween. A stripping mechanism a skive assembly having an elongated, thin, flexible skive finger, wherein a tip of the skive finger is beveled forming a sharp edge along an upper surface of the skive finger. At least one raised bump protrudes from the lower surface of the skive finger, spaced apart from a tip of the skive finger. A mounting mechanism positions the skive finger in operative relation to the first roller with the at least one raised bump contacting the surface of the first roller at a contact point such that the sharp edge along the first surface of the skive finger is spaced apart from the surface of the first roller by a distance of between 50 and 120 microns.

11 Claims, 13 Drawing Sheets

USER STRIPPING MECHANISM WITH PROTRUSION

CROSS-REFERENCE TO RELATED APPLICATIONS

Reference is made to commonly assigned, co-pending U.S. Patent application Ser. No. 16/153,899, entitled: "Fuser stripping mechanism with beveled tip", by D. Cahill et al., which is incorporated herein by reference.

FIELD OF THE INVENTION

This invention pertains to the field of electrographic printing and more particularly to a receiver medium stripping mechanism for a fuser apparatus.

BACKGROUND OF THE INVENTION

Electrophotography is a useful process for printing images on a receiver (or "imaging substrate"), such as a piece or sheet of paper or another planar medium (e.g., glass, fabric, metal, or other objects) as will be described below. In this process, an electrostatic latent image is formed on a photoreceptor by uniformly charging the photoreceptor and then discharging selected areas of the uniform charge to yield an electrostatic charge pattern corresponding to the desired image (i.e., a "latent image").

After the latent image is formed, charged toner particles are brought into the vicinity of the photoreceptor and are attracted to the latent image to develop the latent image into a toner image. Note that the toner image may not be visible to the naked eye depending on the composition of the toner particles (e.g., clear toner).

After the latent image is developed into a toner image on the photoreceptor, a suitable receiver is brought into juxtaposition with the toner image. A suitable electric field is applied to transfer the toner particles of the toner image to the receiver to form the desired print image on the receiver. The imaging process is typically repeated many times with reusable photoreceptors.

The receiver is then removed from its operative association with the photoreceptor and subjected to heat or pressure to permanently fix (i.e., "fuse") the print image to the receiver. Plural print images (e.g., separation images of different colors) can be overlaid on the receiver before fusing to form a multicolor print image on the receiver.

Contact fusing systems consist of a heated surface where the image and the support media is pressed against until the toner is sufficiently melted to adhere to the support media. The heated fusing surface can be roller or a heated fusing belt. The media and toner are pressed against the fuser surface with either a pressure roller or pressure belt. This roller or belt can be heated or un-heated.

For printing systems where the toner used does not include additives (e.g., release wax) to prevent adhesion of the toner to the fuser surface, a release fluid (e.g., an oil) is typically applied to the fuser surface prior to the media being fused. With printing systems that print on cut sheets of media, an interframe gap separates consecutive sheets. During this interframe gap some of the release fluid applied to the fusing surface will transfer to the pressure roller surface. In many printing systems, a contact skive is used to strip the media from the pressure roller. In such cases, any release fluid that transfers to the pressure roller can be skived by the contact skive and collect on its surface. The release fluid on the skive surface can then transfer to the back side of subsequent sheets of media. This can cause objectionable artifacts, particularly when printing in a duplex (i.e., double-sided) print mode. In this case, any release fluid which transfers to the back side of the substrate in the fusing subsystem can wet the imaging surface when the second side image is being printed by the imaging module. The release fluid on the imaging surface can then cause the printed density to be higher or lower in the corresponding image areas, which can produce undesirable image artifacts. Such artifacts can persist for many sheets of media until the release fluid is removed from the imaging surface. Drops of release fluid on the surface of the media can also cause differential gloss artifacts, or can transfer to adjacent pieces of media in the output tray producing visible surface artifacts, even in a single-sided printing mode.

There remains a need for a stripping mechanism for a fuser apparatus which effective strips the receiver medium from the fuser roller without causing the receiver medium to be contaminated with differential levels of release agent.

SUMMARY OF THE INVENTION

The present invention represents a fuser apparatus including:

first and second rollers in nip relation to transport a receiver member therebetween and to permanently fuse marking particles to the receiver member under application of heat and pressure; and a stripping mechanism for stripping the receiver member from the first roller, the stripping member including one or more skive assemblies, each skive assembly including:

- an elongated, thin, flexible skive finger having a first surface, a second surface, and at least one raised bump protruding from the second surface spaced apart from a tip of the skive finger, wherein the tip of the skive finger is beveled with at least one bevel surface forming a sharp edge along the first surface having a tip angle of less than 25 degrees; and
- a mounting mechanism for positioning the skive finger in operative relation to the first roller such that the at least one raised bump protruding from the second surface of the skive finger contacts a surface of the first roller at a contact point such that the sharp edge along the first surface of the skive finger is spaced apart from the surface of the first roller by a distance of between 50 and 120 microns.

This invention has the advantage that skive finger has a well-controlled tip gap across a wide range of operating conditions.

It has the additional advantage that any release agent on the surface of the roller flows around the bump(s) and is prevented from flowing onto the receiver side of the skive finger, where it could subsequently transfer to the receiver. This has the result of reducing image artifacts that can be caused when release agent transfers to the receiver.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

Figure 1:
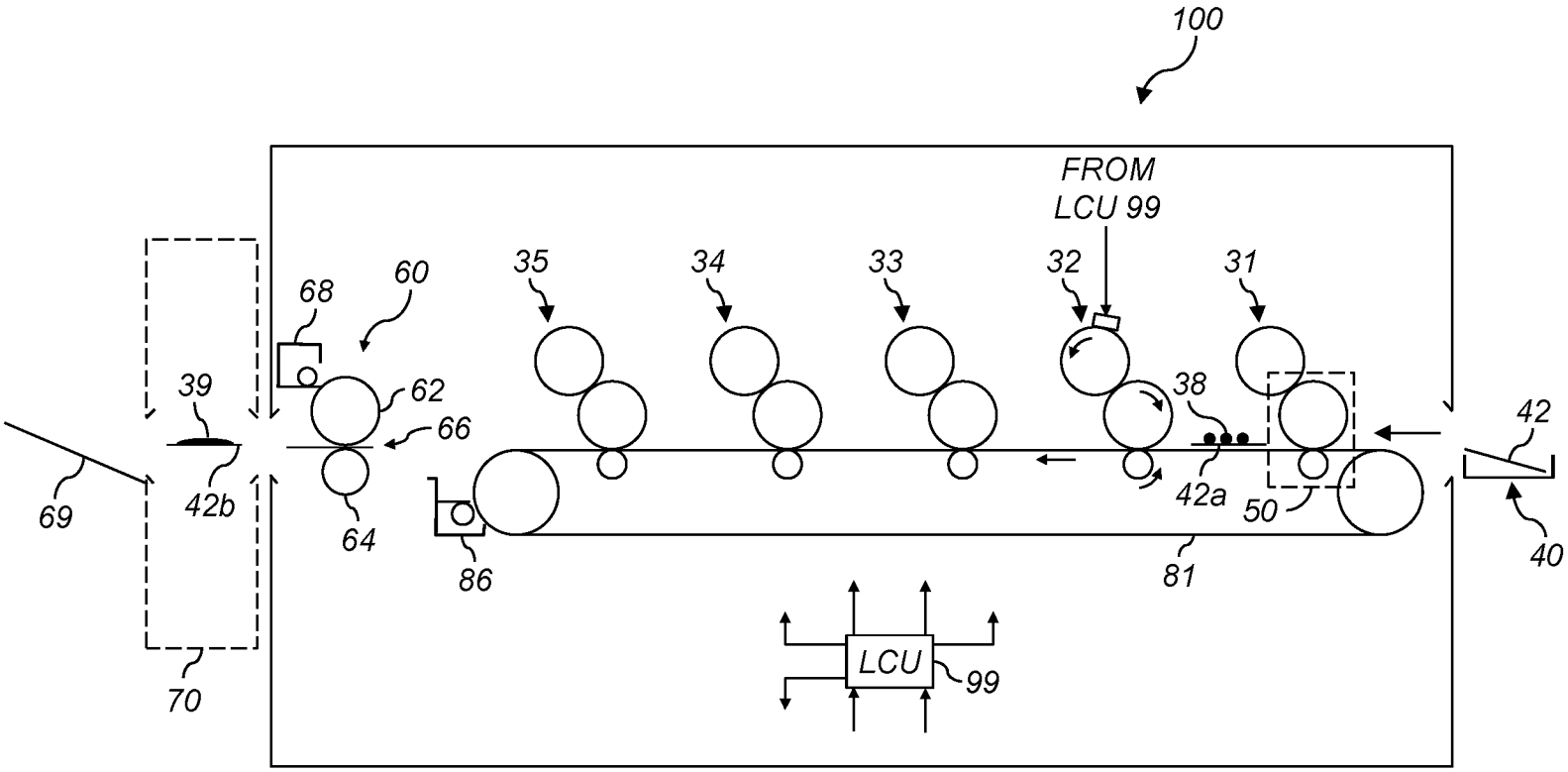
FIG. 1 (Prior Art)
FIG. 1 is an elevational cross-section of an electrophotographic printer suitable for use with various embodiments.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated, or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

As used herein, the terms "parallel" and "perpendicular" have a tolerance of ±10.

As used herein, "sheet" is a discrete piece of media, such as receiver media for an electrophotographic printer (described below). Sheets have a length and a width. Sheets are folded along fold axes (e.g., positioned in the center of the sheet in the length dimension, and extending the full width of the sheet). The folded sheet contains two "leaves," each leaf being that portion of the sheet on one side of the fold axis. The two sides of each leaf are referred to as "pages." "Face" refers to one side of the sheet, whether before or after folding.

As used herein, "toner particles" are particles of one or more material(s) that are transferred by an electrophotographic (EP) printer to a receiver to produce a desired effect or structure (e.g., a print image, texture, pattern, or coating) on the receiver. Toner particles can be ground from larger solids, or chemically prepared (e.g., precipitated from a solution of a pigment and a dispersant using an organic solvent), as is known in the art. Toner particles can have a range of diameters (e.g., less than 8 μm, on the order of 10-15 μm, up to approximately 30 μm, or larger), where "diameter" preferably refers to the volume-weighted median diameter, as determined by a device such as a Coulter Multisizer. When practicing this invention, it is preferable to use larger toner particles (i.e., those having diameters of at least 20 μm) in order to obtain the desirable toner stack heights that would enable macroscopic toner relief structures to be formed.

"Toner" refers to a material or mixture that contains toner particles, and that can be used to form an image, pattern, or coating when deposited on an imaging member including a photoreceptor, a photoconductor, or an electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

As mentioned already, toner includes toner particles; it can also include other types of particles. The particles in toner can be of various types and have various properties. Such properties can include absorption of incident electromagnetic radiation (e.g., particles containing colorants such as dyes or pigments), absorption of moisture or gasses (e.g., desiccants or getters), suppression of bacterial growth (e.g., biocides, particularly useful in liquid-toner systems), adhesion to the receiver (e.g., binders), electrical conductivity or low magnetic reluctance (e.g., metal particles), electrical resistivity, texture, gloss, magnetic remanence, florescence, resistance to etchants, and other properties of additives known in the art.

In single-component or mono-component development systems, "developer" refers to toner alone. In these systems, none, some, or all of the particles in the toner can themselves be magnetic. However, developer in a mono-component system does not include magnetic carrier particles. In dual-component, two-component, or multi-component development systems, "developer" refers to a mixture including toner particles and magnetic carrier particles, which can be electrically-conductive or -non-conductive. Toner particles can be magnetic or non-magnetic. The carrier particles can be larger than the toner particles (e.g., 15-20 μm or 20-300 μm in diameter). A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various embodiments described herein are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields). The present invention can be practiced using any type of electrographic printing system, including electrophotographic and ionographic printers.

A digital reproduction printing system ("printer") typically includes a digital front-end processor (DFE), a print engine (also referred to in the art as a "marking engine") for applying toner to the receiver, and one or more post-printing finishing system(s) (e.g., a UV coating system, a glosser system, or a laminator system). A printer can reproduce pleasing black-and-white or color images onto a receiver. A printer can also produce selected patterns of toner on a receiver, which patterns (e.g., surface textures) do not correspond directly to a visible image.

The DFE receives input electronic files (such as Postscript command files) composed of images from other input devices (e.g., a scanner, a digital camera or a computer-generated image processor). Within the context of the present invention, images can include photographic renditions of scenes, as well as other types of visual content such as text or graphical elements. Images can also include invisible content such as specifications of texture, gloss or protective coating patterns.

The DFE can include various function processors, such as a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system that accounts for characteristics of the image printing process implemented in the print engine (e.g., the electrophotographic process) to provide known, consistent color reproduction characteristics. The color management system can also provide known color reproduction for different inputs (e.g., digital camera images or film images). Color management systems are well-known in the art, and any such system can be used to provide color corrections in accordance with the present invention.

In an embodiment of an electrophotographic modular printing machine useful with various embodiments (e.g., the NEXPRESS SX 3900 printer manufactured by Eastman Kodak Company of Rochester, N.Y.) color-toner print images are made in a plurality of color imaging modules arranged in tandem, and the print images are successively electrostatically transferred to a receiver adhered to a transport web moving through the modules. Colored toners include colorants, (e.g., dyes or pigments) which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing features such as protecting the print from fingerprints, reducing certain visual artifacts or providing desired texture or surface finish characteristics. Clear toner uses particles that are similar to the toner particles of the color development stations but without colored material (e.g., dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

Figure 2:
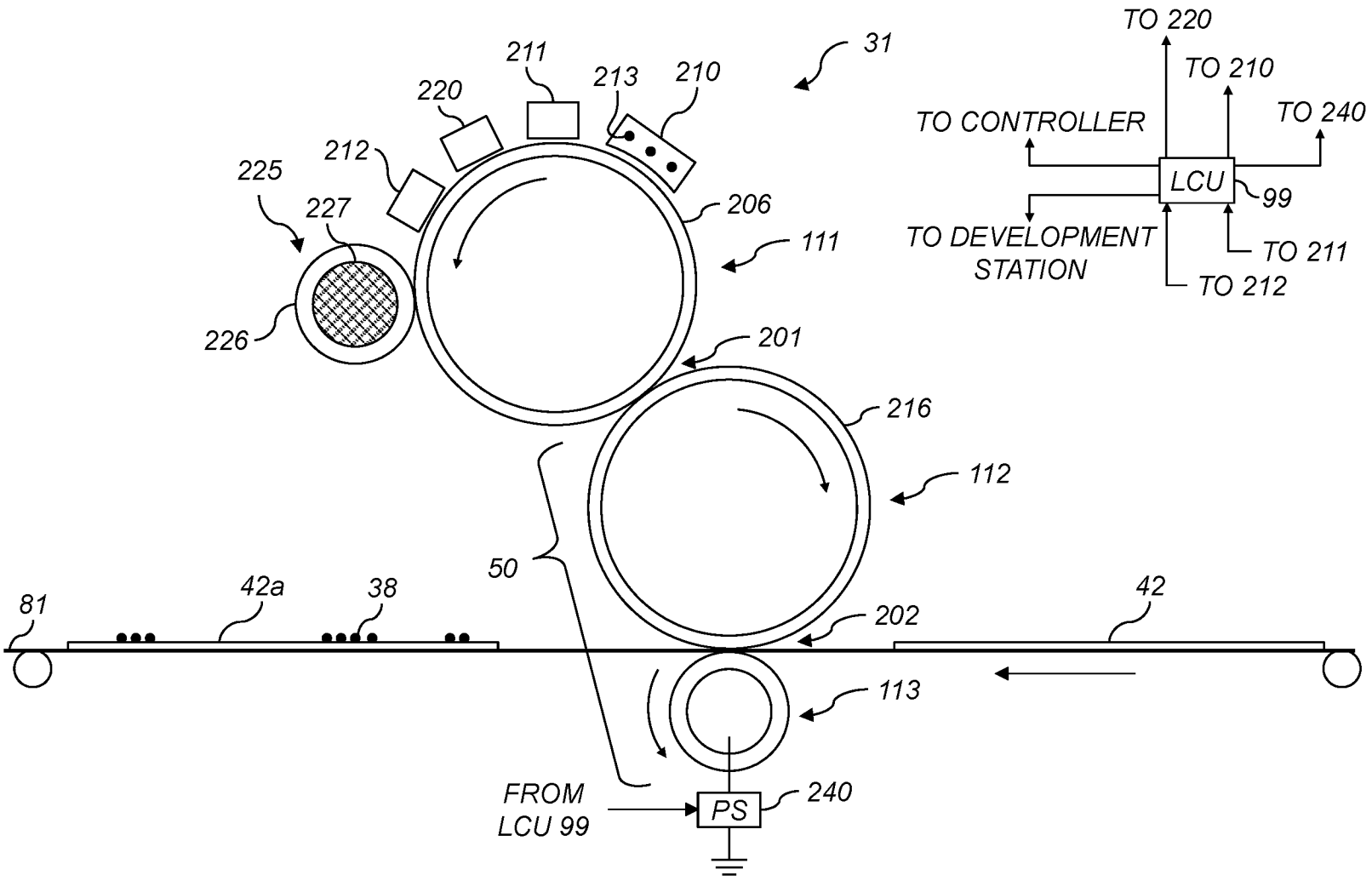
FIG. 2 (Prior Art)
FIG. 2 is an elevational cross-section of one printing module of the electrophotographic printer of FIG. 1.

FIGS. 1-2 are elevational cross-sections showing portions of a typical electrophotographic printer 100 useful with various embodiments. Printer 100 is adapted to produce images, such as single-color images (i.e., monochrome images), or multicolor images such as CMYK, or pentachrome (five-color) images, on a receiver. Multicolor images are also known as "multi-component" images. One embodiment involves printing using an electrophotographic print engine having five sets of single-color image-producing or image-printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module 31, 32, 33, 34, 35 produces a single-color toner image for transfer using a respective transfer subsystem 50 (for clarity, only one is labeled) to a receiver 42 successively moved through the modules. In some embodiments one or more of the printing module 31, 32, 33, 34, 35 can print a colorless toner image, which can be used to provide a protective overcoat or tactile image features. Receiver 42 is transported from supply unit 40, which can include active feeding subsystems as known in the art, into printer 100 using a transport web 81. In various embodiments, the visible image can be transferred directly from an imaging roller to a receiver, or from an imaging roller to one or more transfer roller(s) or belt(s) in sequence in transfer subsystem 50, and then to receiver 42. Receiver 42 is, for example, a selected section of a web or a cut sheet of a planar receiver media such as paper or transparency film.

In the illustrated embodiments, each receiver 42 can have up to five single-color toner images transferred in registration thereon during a single pass through the five printing modules 31, 32, 33, 34, 35 to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an exemplary embodiment, printing module 31 forms black (K) print images, printing module 32 forms yellow (Y) print images, printing module 33 forms magenta (M) print images, and printing module 34 forms cyan (C) print images.

Printing module 35 can form a red, blue, green, or other fifth print image, including an image formed from a clear toner (e.g., one lacking pigment). The four subtractive primary colors, cyan, magenta, yellow, and black, can be combined in various combinations of subsets thereof to form a representative spectrum of colors. The color gamut of a printer (i.e., the range of colors that can be produced by the printer) is dependent upon the materials used and the process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g., metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42*a* is shown after passing through printing module 31. Print image 38 on receiver 42*a* includes unfused toner particles. Subsequent to transfer of the respective print images, overlaid in registration, one from each of the respective printing modules 31, 32, 33, 34, 35, receiver 42*a* is advanced to a fuser module 60 (i.e., a fusing or fixing assembly) to fuse the print image 38 to the receiver 42*a*. Transport web 81 transports the print-image-carrying receivers to the fuser module 60, which fixes the toner particles to the respective receivers, generally by the application of heat and pressure. The receivers are serially de-tacked from the transport web 81 to permit them to feed cleanly into the fuser module 60. The transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along the transport web 81 before or after cleaning station 86 in the direction of rotation of transport web 81.

In the illustrated embodiment, the fuser module 60 includes a heated fusing roller 62 and an opposing pressure roller 64 that form a fusing nip 66 therebetween. The pressure roller 64 can also be referred to as a backing roller. In an embodiment, fuser module 60 also includes a release agent application substation 68 that applies release fluid, e.g., silicone oil, to fusing roller 62. Alternatively, wax-containing toner can be used without applying release fluid to the fusing roller 62. Other embodiments of fusers, both contact and non-contact, can be employed. For example, solvent fixing uses solvents to soften the toner particles so they bond with the receiver. Photoflash fusing uses short bursts of high-frequency electromagnetic radiation (e.g., ultraviolet light) to melt the toner. Radiant fixing uses lower-frequency electromagnetic radiation (e.g., infrared light) to more slowly melt the toner. Microwave fixing uses electromagnetic radiation in the microwave range to heat the receivers (primarily), thereby causing the toner particles to melt by heat conduction, so that the toner is fixed to the receiver.

The fused receivers (e.g., receiver 42*b* carrying fused image 39) are transported in series from the fuser module 60 along a path either to an output tray 69, or back to printing modules 31, 32, 33, 34, 35 to form an image on the backside of the receiver (i.e., to form a duplex print). Receivers 42*b* can also be transported to any suitable output accessory. For example, an auxiliary fuser or glossing assembly can provide a clear-toner overcoat. Printer 100 can also include multiple fuser modules 60 to support applications such as overprinting, as known in the art.

In various embodiments, between the fuser module 60 and the output tray 69, receiver 42*b* passes through a finisher 70. Finisher 70 performs various paper-handling operations, such as folding, stapling, saddle-stitching, collating, and binding.

Printer 100 includes main printer apparatus logic and control unit (LCU) 99, which receives input signals from various sensors associated with printer 100 and sends control signals to various components of printer 100. LCU 99 can include a microprocessor incorporating suitable look-up tables and control software executable by the LCU 99. It can also include a field-programmable gate array (FPGA), programmable logic device (PLD), programmable logic controller (PLC) (with a program in, e.g., ladder logic), microcontroller, or other digital control system. LCU 99 can include memory for storing control software and data. In some embodiments, sensors associated with the fuser module 60 provide appropriate signals to the LCU 99. In response to the sensor signals, the LCU 99 issues command and control signals that adjust the heat or pressure within fusing nip 66 and other operating parameters of fuser module 60. This permits printer 100 to print on receivers of various thicknesses and surface finishes, such as glossy or matte.

Image data for printing by printer 100 can be processed by a raster image processor (RIP; not shown), which can include a color separation screen generator or generators. The output of the RIP can be stored in frame or line buffers for transmission of the color separation print data to each of a set of respective LED writers associated with the printing modules 31, 32, 33, 34, 35 (e.g., for black (K), yellow (Y), magenta (M), cyan (C), and red (R) color channels, respectively). The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes (e.g., color correction) in order to obtain the desired color print. Color image data is separated into the respective colors and converted by the RIP to halftone dot image data in the respective color (for example, using halftone matrices, which provide desired screen angles and screen rulings). The RIP can be a suitably-programmed computer or logic device and is adapted to employ stored or computed halftone matrices and templates for processing separated color image data into rendered image data in the form of halftone information suitable for printing. These halftone matrices can be stored in a screen pattern memory.

FIG. 2 shows additional details of printing module 31, which is representative of printing modules 32, 33, 34, and 35 (FIG. 1). Photoreceptor 206 of imaging member 111 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors can include a homogeneous layer of a single material such as vitreous selenium or a composite layer containing a photoconductor and another material. Photoreceptors 206 can also contain multiple layers.

Charging subsystem 210 applies a uniform electrostatic charge to photoreceptor 206 of imaging member 111. In an exemplary embodiment, charging subsystem 210 includes a wire grid 213 having a selected voltage. Additional necessary components provided for control can be assembled about the various process elements of the respective printing modules. Meter 211 measures the uniform electrostatic charge provided by charging subsystem 210.

An exposure subsystem 220 is provided for selectively modulating the uniform electrostatic charge on photoreceptor 206 in an image-wise fashion by exposing photoreceptor 206 to electromagnetic radiation to form a latent electrostatic image. The uniformly-charged photoreceptor 206 is typically exposed to actinic radiation provided by selectively activating particular light sources in an LED array or a laser device outputting light directed onto photoreceptor 206. In embodiments using laser devices, a rotating polygon (not shown) is sometimes used to scan one or more laser beam(s) across the photoreceptor in the fast-scan direction. One pixel site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each pixel site in the row during that line exposure time.

As used herein, an "engine pixel" is the smallest addressable unit on photoreceptor 206 which the exposure subsystem 220 (e.g., the laser or the LED) can expose with a selected exposure different from the exposure of another engine pixel. Engine pixels can overlap (e.g., to increase addressability in the slow-scan direction). Each engine pixel has a corresponding engine pixel location, and the exposure applied to the engine pixel location is described by an engine pixel level.

The exposure subsystem 220 can be a write-white or write-black system. In a write-white or "charged-area-development" system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or "discharged-area development" system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

In the illustrated embodiment, meter 212 is provided to measure the post-exposure surface potential within a patch area of a latent image formed from time to time in a non-image area on photoreceptor 206. Other meters and components can also be included (not shown).

A development station 225 includes toning shell 226, which can be rotating or stationary, for applying toner of a selected color to the latent image on photoreceptor 206 to produce a developed image on photoreceptor 206 corresponding to the color of toner deposited at this printing module 31. Development station 225 is electrically biased by a suitable respective voltage to develop the respective latent image, which voltage can be supplied by a power supply (not shown). Developer is provided to toning shell 226 by a supply system (not shown) such as a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In some embodiments, the development station 225 employs a two-component developer that includes toner particles and magnetic carrier particles. The exemplary development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Development station 225 can also employ a mono-component developer comprising toner, either magnetic or non-magnetic, without separate magnetic carrier particles.

Transfer subsystem 50 includes transfer backup member 113, and intermediate transfer member 112 for transferring the respective print image from photoreceptor 206 of imaging member 111 through a first transfer nip 201 to surface 216 of intermediate transfer member 112, and thence to a receiver 42 which receives respective toned print images 38 from each printing module in superposition to form a composite image thereon. The print image 38 is, for example, a separation of one color, such as cyan. Receiver 42 is transported by transport web 81. Transfer to a receiver is effected by an electrical field provided to transfer backup member 113 by power source 240, which is controlled by LCU 99. Receiver 42 can be any object or surface onto which toner can be transferred from imaging member 111 by application of the electric field. In this example, receiver 42 is shown prior to entry into a second transfer nip 202, and receiver **42*a* is shown subsequent to transfer of the print image 38 onto receiver 42*a***.

In the illustrated embodiment, the toner image is transferred from the photoreceptor 206 to the intermediate transfer member 112, and from there to the receiver 42. Registration of the separate toner images is achieved by registering the separate toner images on the receiver 42, as is done with the NEXPRESS SX 3900. In some embodiments, a single transfer member is used to sequentially transfer toner images from each color channel to the receiver 42. In other embodiments, the separate toner images can be transferred in register directly from the photoreceptor 206 in the respective printing module 31, 32, 33, 34, 25 to the receiver 42 without using a transfer member. Either transfer process is suitable when practicing this invention. An alternative method of transferring toner images involves transferring the separate toner images, in register, to a transfer member and then transferring the registered image to a receiver.

LCU 99 sends control signals to the charging subsystem 210, the exposure subsystem 220, and the respective development station 225 of each printing module 31, 32, 33, 34, 35 (FIG. 1), among other components. Each printing module can also have its own respective controller (not shown) coupled to LCU 99.

Figure 3:
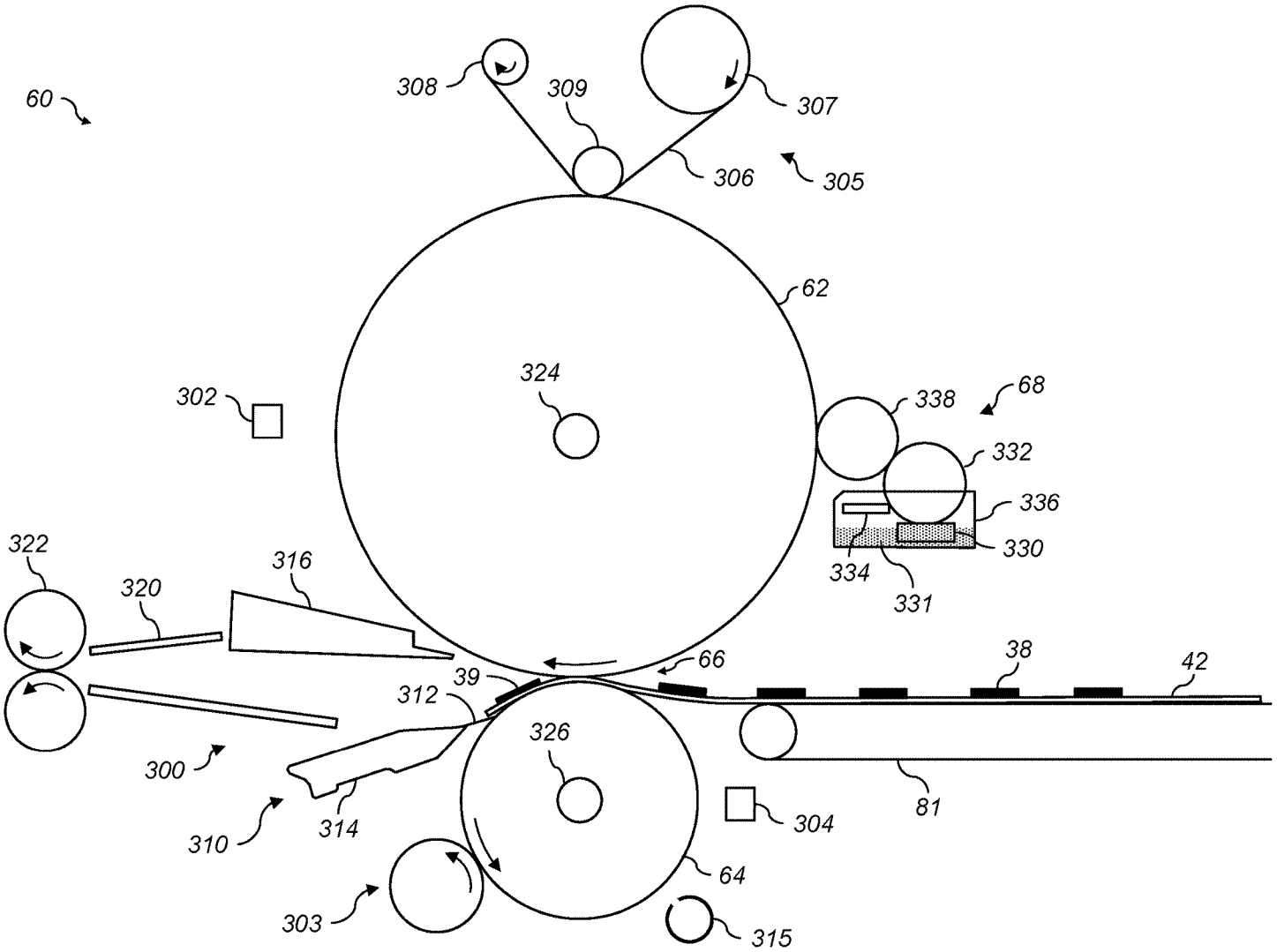
FIG. 3 illustrates a schematic side view of a fuser module in accordance with an exemplary embodiment.

Aspects of the present invention will now be described with reference to FIG. 3, which shows an exemplary fuser module 60. The fuser module 60 includes a fusing roller 62 and a pressure roller 64. Receiver 42 including an unfused print image 38 is fed into a nip 66 between the fusing roller 62 and the pressure roller 64 by a transport web 81. The heated fusing roller 62 fuses the toner to the receiver 42 to provide a fused image 39. The receiver 42 with the fused image is then directed by paper guides 320 into exit rollers 322.

In the illustrated embodiment, the fusing roller 62 is an internally heated roller which includes a heating element such as an infrared heater lamp 324 to heat the surface of the fusing roller 62. In other embodiments, an externally heated fusing roller 62 can be used where heat is supplied to the fusing roller 62 from an external component such as one or more heated rollers.

A fusing roller temperature sensor 302 senses the temperature of the surface of the fusing roller 62. The temperature is fed into a control system which controls the power of the heater lamp 324 to maintain the fusing roller 62 at a specified temperature.

In some embodiments, the pressure roller 64 can also include an optional heater lamp 326, although this is commonly unnecessary. An optional pressure roller cooler 315 can be used to cool the surface of the pressure roller 64. For example, the pressure roller cooler can be a hollow tube with a series of holes or slots to direct air onto the surface of the pressure roller 64. The power supplied by the heater lamp 326 and the flow of air through the pressure roller cooler 315 can be controlled in response to the signal from a pressure roller temperature sensor 304 to maintain the pressure roller 64 at a specified temperature.

Release agent application substation 68 includes a release agent reservoir 336 containing a release agent 331. The release agent 331 is typically a silicone-based oil and is designed to prevent toner from adhering to the fusing roller 62. In an exemplary embodiment, the release agent 331 is organo-functional polydimethylsiloxane. A wick pad 330 is submerged in the release agent 331 and transfers release agent 331 from the release agent reservoir 336 to a metering roller 332. the wick pad 330 also functions to clean the surface of the metering roller 332. The metering roller 332 typically has a textured surface with a pattern of recesses. A metering blade 334 skives off the surface of the metering roller 332 to provide a controlled amount of the release agent 331 on the surface. The release agent 331 is then transferred from the metering roller 332 to a donor roller 338, and from there to the fusing roller 62.

Air skive 316 directs a stream of air toward the fusing nip 66. As the receiver 42 exits the fusing nip 66, the air stream of air gets between the fusing roller 62 and the receiver 42 to separate the receiver 42 from the surface of the fusing roller 62. The air skive 316 is sometimes referred to as an air knife.

A stripping mechanism 300 includes one or more skive assemblies 310. Each skive assembly includes a skive finger 312 mounted in a mounting mechanism 314. In the illustrated configuration, the skive fingers 312 are contact skives that contact the surface of the pressure roller 64 and are used to strip the receiver away from the roller surface. Contact skives have the advantage that they are less expensive than air skives which strip the receiver from the roller surface with high velocity air. The unfortunate side effect of a contact skive is they not only strip the receiver, but will also strip whatever else may be on the roller surface. This can include debris such as paper dust and toner particles, as well as any release agent 331 that may have been transferred to the roller surface. With conventional contact skives, the release agent 331 can collect on the receiver side of the skive finger 312, where it can be transferred to the receiver 42. This can cause artifacts, particularly for the case of two-sided printing where the receiver 42 makes a second pass through the printer 100 (FIG. 1). One way of circumventing this problem would be to make the skive fingers 312 non-contacting. However, a significant problem with making non-contacting skives work is maintaining the required gap between the tip of the skive finger 312 and the roller. Typically, the required gap should be no greater than the thinnest receiver 42 that needs to be stripped. For machines which print down to 59 gsm bond paper, this gap needs to be about 70 μm. A gap this small is impossible to maintain without the ability for the skive to follow the surface of the roller. As will be discussed later, the skive fingers 312 of the present invention have particular characteristics that maintain a specified tip gap while particular features on the skive fingers 312 maintain contact with the roller. This is effective to prevent release agent 331 from collecting on the paper side of the skive fingers 312.

Fusing roller cleaner assembly 305 is used to clean the surface of the fusing roller 62 to remove residual toner particles after the receiver 42 separates from the fusing nip 66. The Fusing roller cleaner assembly 305 includes a cleaning web 306 which travels from a supply roll 307 around a web back-up roller 309 to a take-up roll 308. The cleaning web 306 is typically a fabric made of a synthetic polymer such as aramid.

A pressure roller cleaner 303 is provided to clean the surface of the pressure roller 64. In an exemplary embodiment, the pressure roller cleaner 303 is wrapped with a fabric made of a synthetic polymer such as aramid or polyamide, and counter-rotates relative to the pressure roller 64. The pressure roller cleaner 303 removes residual debris such as paper dust and toner particles, and it also serves to uniformly spread any release agent 331 that is transferred to the pressure roller 64 in the inter-frame gap between pages of receiver 42.

Figure 4:
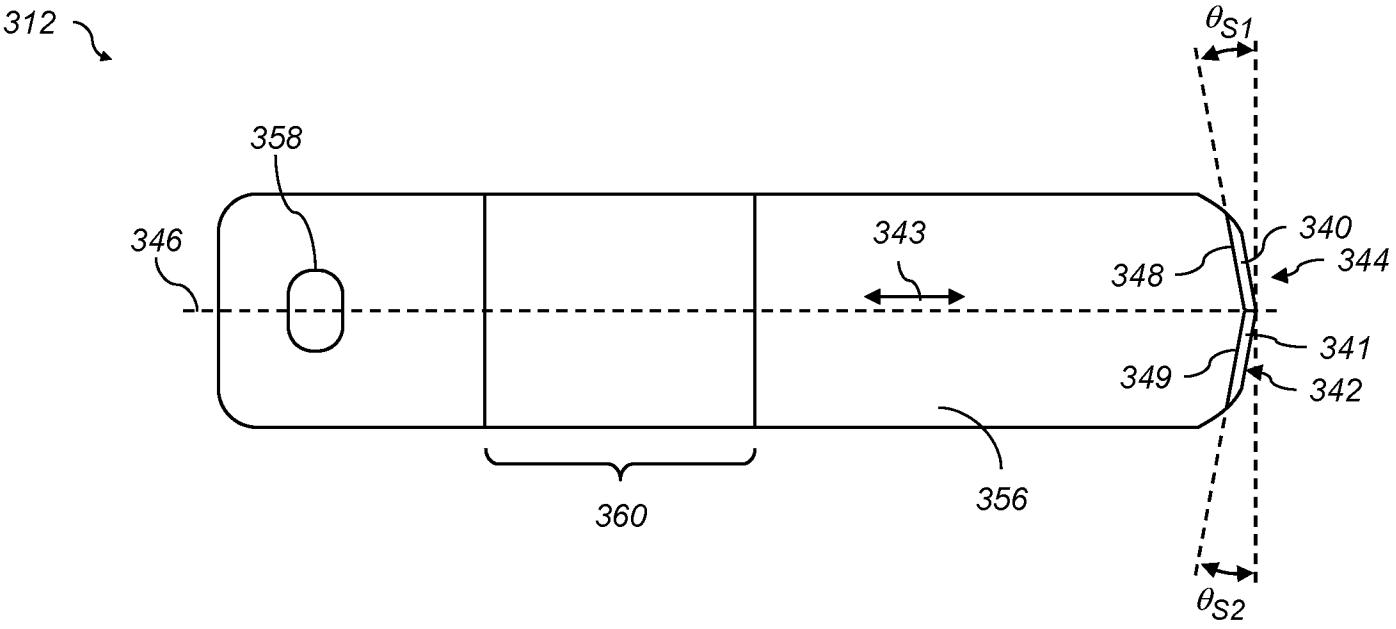
FIG. 4 illustrates a bottom view of an exemplary skive finger in accordance with a first configuration.
Figure 5:
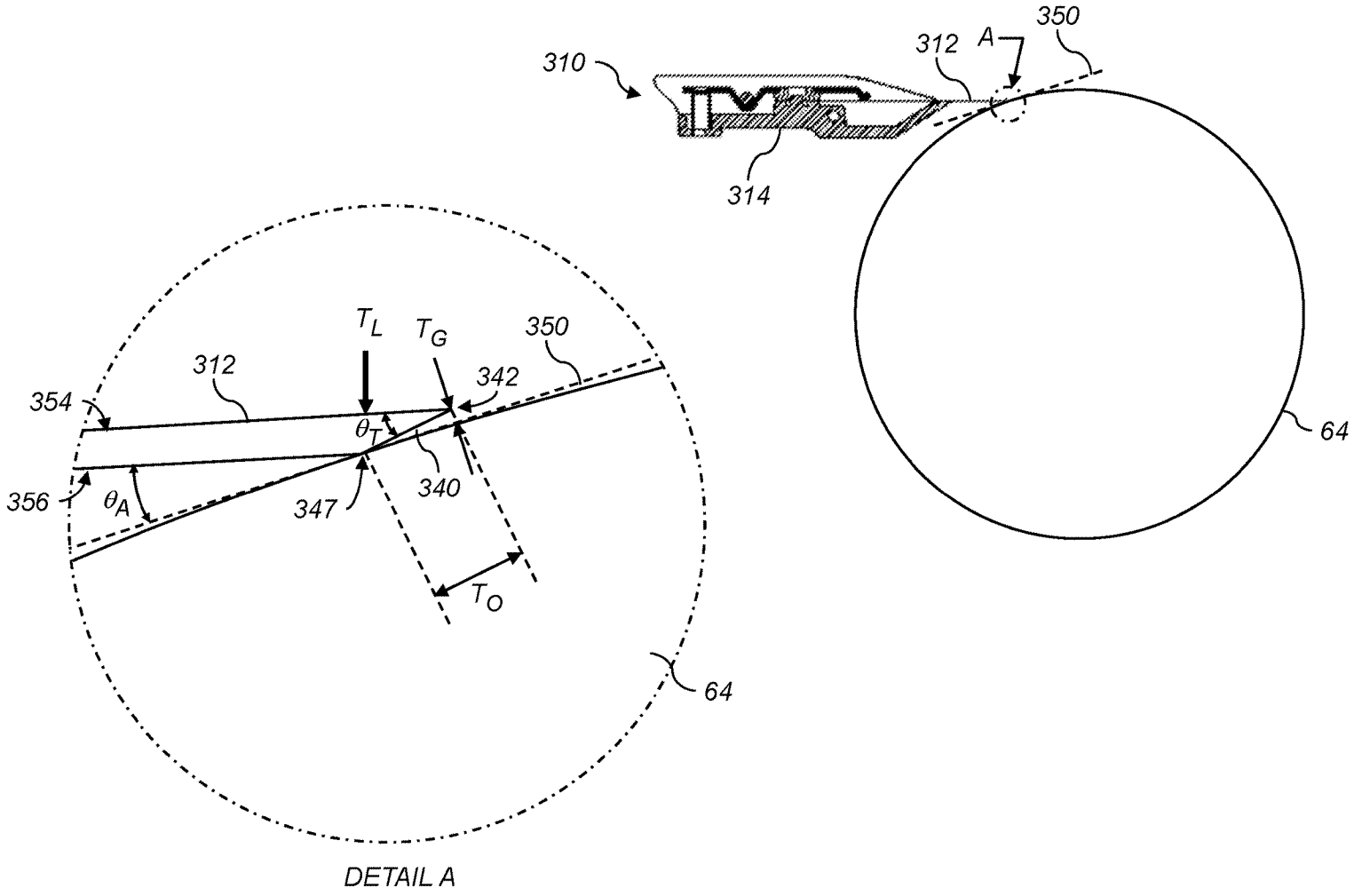
FIG. 5 shows a cross-sectional side view the skive finger of FIG. 4 in operational position relative to a fuser module pressure roller.

FIG. 4 shows a bottom view of a skive finger 312 in accordance with an exemplary embodiment of the present invention. A cross-sectional side view of the skive finger 312 is shown in FIG. 5. The skive finger 312 is made of a thin flexible material such as metal or plastic. The skive finger 312 has a centerline 346 extending in a length direction 343 to a tip 344. The skive finger 312 has an upper first surface 354 and a bottom second surface 356 which faces the pressure roller 64. The thickness of the skive finger 312 is preferably between 120-500 microns, and more preferably between 200-300 microns. The width of the skive finger 312 is preferably between 2.5-20 mm, and more preferably between 10-15 mm. The tip 344 of the skive finger 312 is rounded, and is beveled with a first and second bevel surfaces 340, 341. The bevel surfaces 340, 341 form a sharp edge 342 along the first surface 354 of the skive finger 312 having a tip angle $\theta_T$ which is preferably between 10-45 degrees, and more preferably between 20-30 degrees. The first bevel surface 340 bevels the tip 344 on a first side of the centerline 346 and the second bevel surface 341 bevels the tip 344 on a second side of the centerline 346. A first intersection line 348 between the first bevel surface 340 and the second surface 356 is oriented at a first sweep angle $\theta_{S1}$ relative to a line normal to the centerline 346, and a second intersection line 349 between the second bevel surface 341 and the second surface 356 is oriented at a second sweep angle $\theta_{S2}$ relative to the line normal to the centerline 346. The magnitude of the first and second sweep angles $\theta_{S1}$, $\theta_{S2}$ are preferably between 5-30 degrees, and more preferably between 10-25 degrees. In the illustrated embodiment, the magnitudes of the first and second sweep angles $\theta_{S1}$, $\theta_{S2}$ are equal, although this is not a requirement. The bevel surfaces 340, 341 act in a manner similar to the bow of a boat to push any release agent 331 on the roller surface to the sides, preventing it from flowing up over the tip 344 onto the upper second surface 354 where it can subsequently be transferred to the receiver 42 (FIG. 3). The illustrated skive finger 312 has a mounting hole 358 to facilitate mounting to the mounting mechanism 314.

As can be seen in enlarged detail A of FIG. 5, the skive finger 312 contacts the surface of the pressure roller 64 at a contact point 347. The skive finger 312 is oriented at an attack angle $\theta_A$ relative to a tangent line 350 to the roller surface. The attack angle is preferably in the range of 5-30 degrees. The attack angle $\theta_A$ and the tip angle $\theta_T$ are selected such that the sharp edge 342 at the tip of the skive finger 312 is maintained at a tip gap $T_G$ away from the roller surface. In a preferred embodiment, the tip gap $T_G$ is between 50-120 μm, and more preferably between 70-100 μm. This is large enough to ensure that the release agent 331 (FIG. 3) does not flow onto the first surface 354 of the skive finger 354, but is small enough so that it is able to separate thin receivers (e.g., down to 75 μm thick) away from the roller surface. This requires that the tip angle $\theta_T$ be larger than the attack angle $\theta_A$. In a preferred embodiment $\theta_T$-$\theta_A$ is between 5-15 degrees. A tip offset $T_O$ between the sharp edge 342 and the contact point 347 is preferably at least 25 μm. In an exemplary embodiment, the thickness of the skive finger 312 is 254 μm, the width of the skive finger 312 is 12 mm, the tip angle $\theta_T$ is 24 degrees, the attack angle $\theta_A$ is 14 degrees, and the sweep angles $\theta_{S1}$, $\theta_{S2}$ are 10 degrees, which produces a tip gap $T_G$ of about 100 μm. This geometry has been found to produce good results over a wide range of media types and system conditions.

The skive finger 312 is pressed against the roller surface with a tip load $T_L$, which is preferably between 75-600 mN, and more preferably between 100-200 mN. In an exemplary embodiment, a tip load of $T_L$=140 mN is used. In the illustrated embodiment, the tip load is controlled by reducing the thickness of the skive finger 312 in a thinned portion 360. In an exemplary configuration, the thickness of the skive finger is about 254 μm, but is reduced to about 100 μm in the thinned portion 360.

Figure 6A:
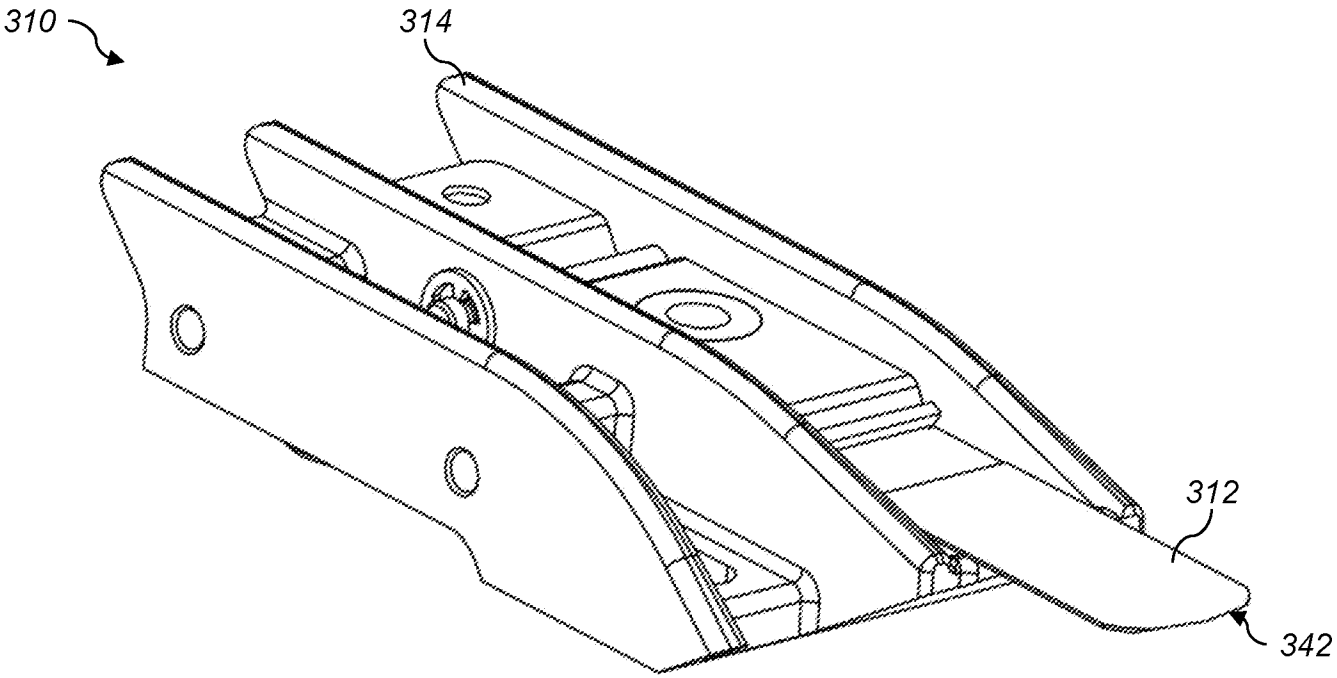
FIGS. 6A-6C illustrate a skive finger mounted in an exemplary mounting mechanism.
Figure 6B:
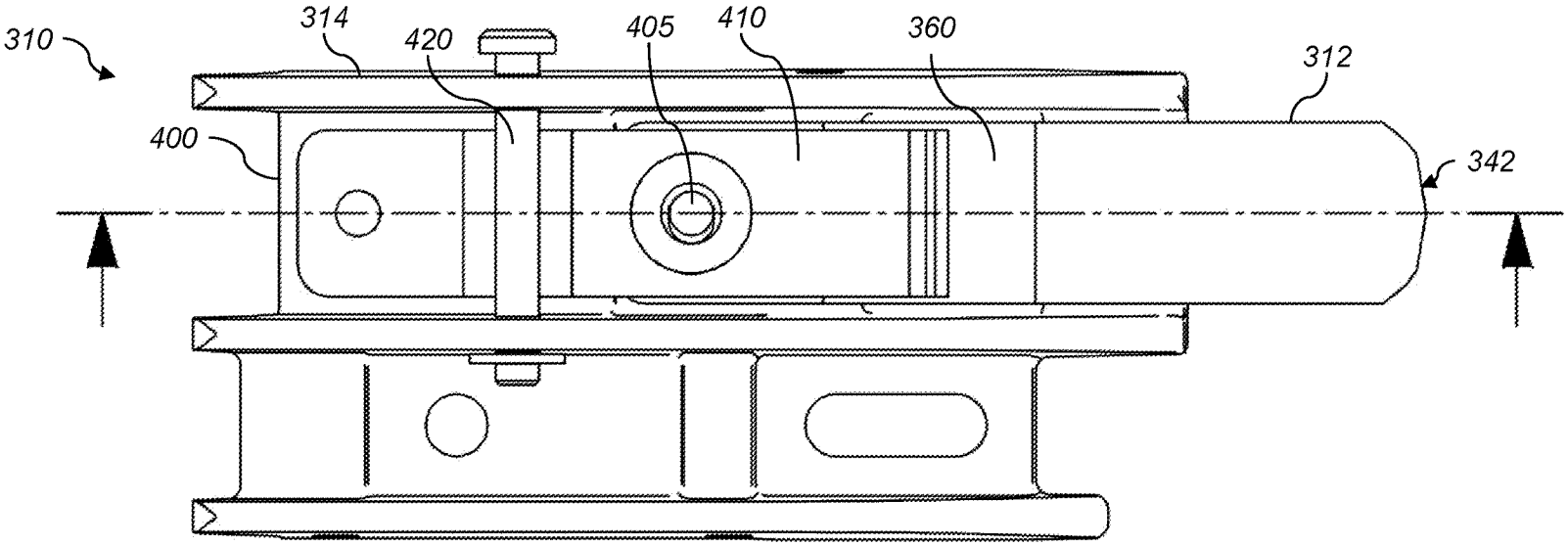
Figure 6C:
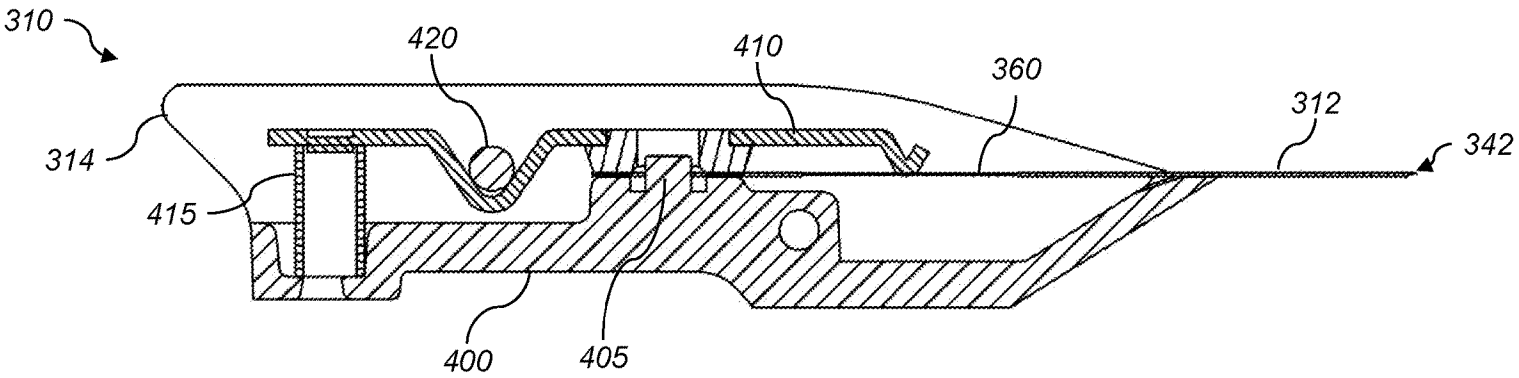

FIG. 6A-6C illustrate additional details of the skive assembly 310 according to an exemplary embodiment. FIG. 6A represents an isometric view of the skive assembly 310, FIG. 6B represents a top view of the skive assembly 310, and FIG. 6C represents a cross-sectional side view of the skive assembly through the cut-line shown in FIG. 6B. As can be seen from FIGS. 6B-6C, the mounting mechanism 314 has a number of different parts, including a skive bracket 400, a skive hold-down 410, a hold-down spring 415, and a hold-down pivot pin 420. To mount the skive finger 312, the back end of the skive hold-down 410 is pressed down, pivoting the skive hold-down 410 around the hold-down pivot pin 420 and compressing the hold-down spring 415. The skive finger 312 can then be inserted, with the mounting hole 358 (FIG. 4) on the skive finger 312 fitting over a mounting pin 405 on the skive bracket 400. The back end of the skive hold-down 410 is then released, clamping the skive finger 312 between the skive bracket 400 and the skive hold-down 410, with the front side of the skive hold-down 410 pressing down on the thinned portion 360 (FIG. 4) of the skive finger 312. It will be obvious to one skilled in the art that in other embodiments any appropriate type of mounting mechanism 314 known in the art can be used to mount the skive finger 312 in operational position relative to the pressure roller 64.

Figure 7:
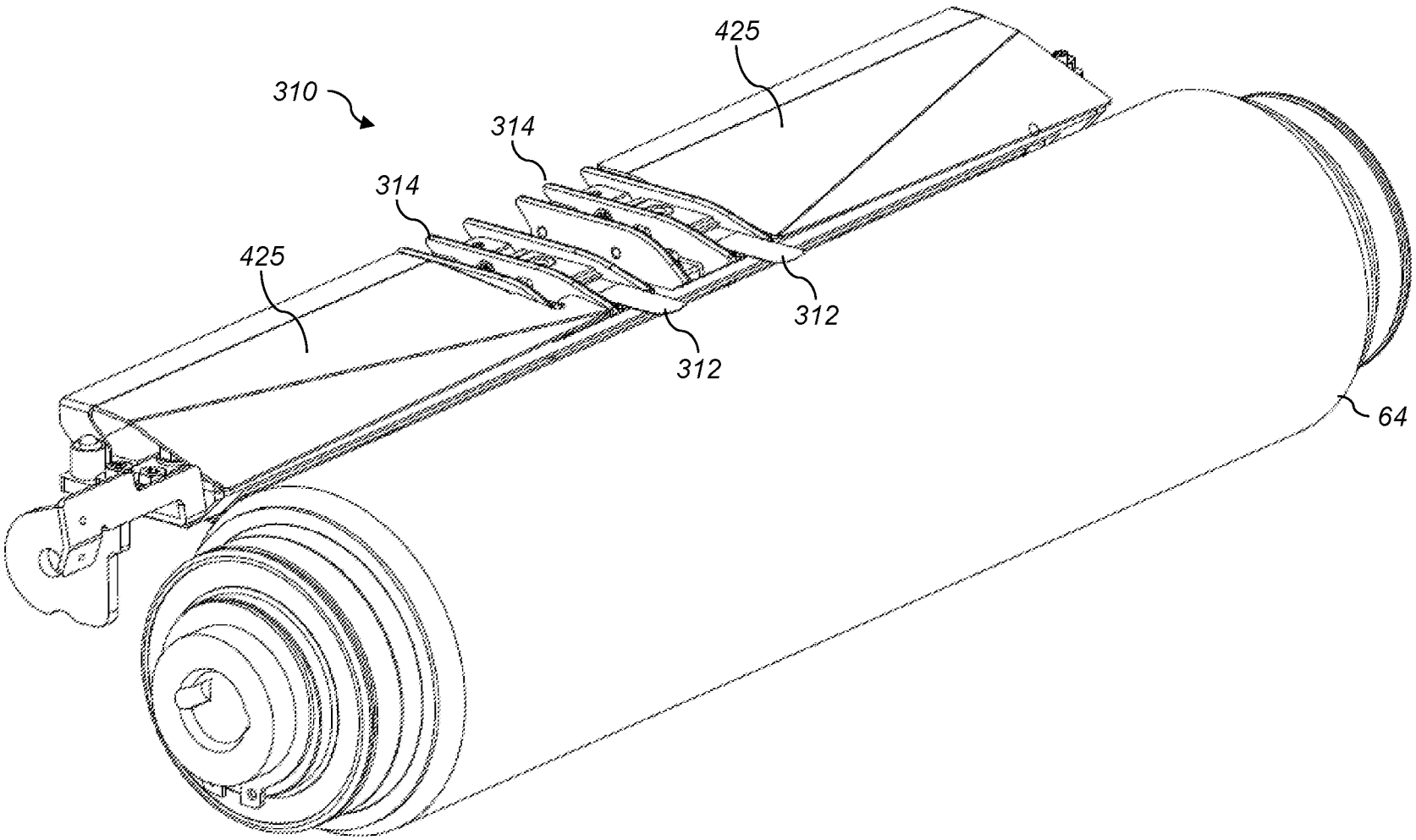
FIG. 7 illustrates a skive assembly including two skive fingers 312 in operational position relative to a fuser module pressure roller.

FIG. 7 illustrates a isometric view of a skive assembly 310 mounted in an operation position relative to pressure roller 64 according to an exemplary embodiment. In this configuration, the skive assembly 310 includes two skive fingers 312 mounted in corresponding mounting mechanisms 314 toward the center of the pressure roller 64. The skive assembly 310 also includes wings 425 to lift the edges of the receiver 42 away from the pressure roller 64.

Figure 8A:
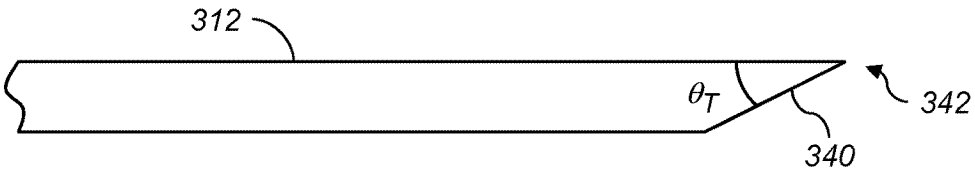
FIGS. 8A-8C show different exemplary shapes for the bevel surfaces.
Figure 8B:
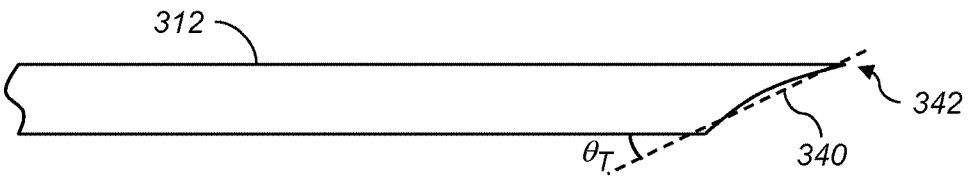
Figure 8C:
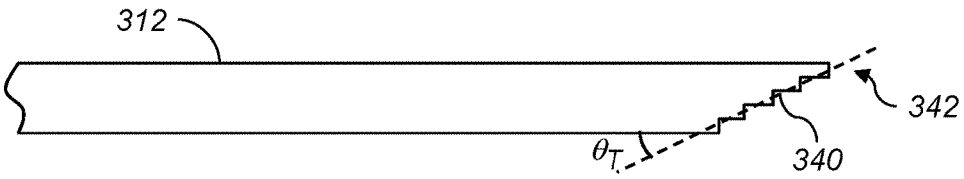

The bevel surfaces 340, 341 formed at the tip 344 of the skive fingers 312 are not necessarily planar surfaces. FIGS. 8A-8C illustrate a number of exemplary cross-sectional profiles that can be used for the bevel surfaces 340, 341. In the example of FIG. 8A the bevel surface 340 is planar so that the cross-sectional profile is a straight line.

In the example of FIG. 8B the bevel surface 340 is a non-planar curved surface so that the cross-sectional profile is a curved line. For example, such curved surfaces can be formed if the bevel surface 340 is fabricated by pressing the skive fingers against a grinding wheel. Note that in the case of curved bevel surfaces, the intersection lines 348, 349 (FIG. 4) between the bevel surfaces 340, 341 and the second side 356 of the skive finger 312 may not be straight lines. In such cases, the sweep angles can be defined using a best-fit straight line through the curved intersection lines 348, 349.

In the example of FIG. 8C the bevel surface 340 has a stepped thickness profile. For example, such surfaces can be formed if the bevel surface 340 is fabricated by using a series of etching processes to remove material in proximity to the tip 344 of the skive finger 312, where the mask used for each etching process is adjusted to expose more (or less) of the skive finger 312 to the etching process.

Since the bevel surfaces 340 in the examples of FIGS. 8*b*-8C are non-planar, the definition of the tip angle $\theta_T$ can be somewhat ambiguous. One method that can be used to define the tip angle $\theta_T$ is to determine a best fit planar surface (as shown by the dashed lines in FIGS. 8*b*-8C), and to calculate the angle $\theta_T$ relative to the best-fit planar surface.

Figure 9:
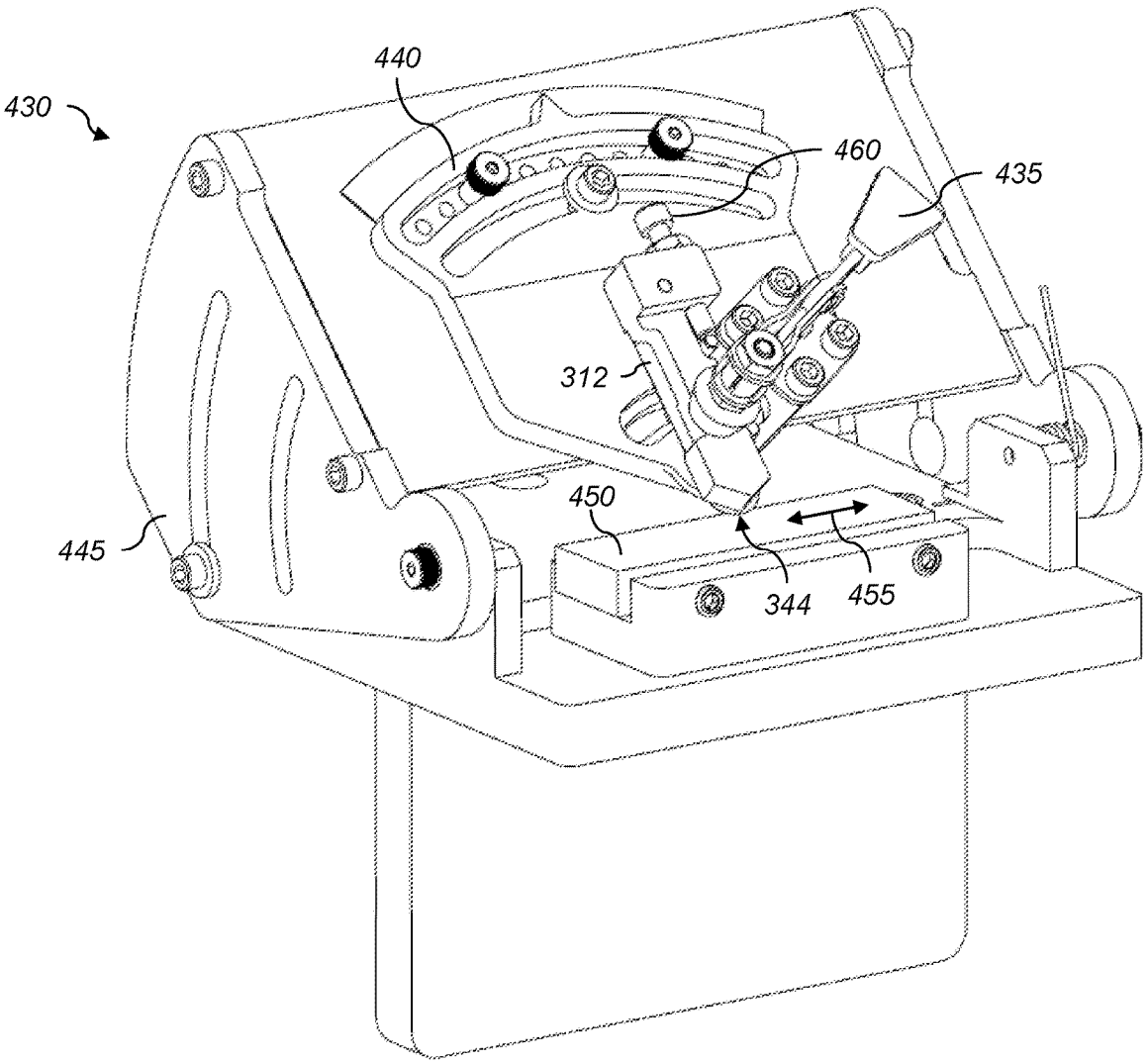
FIG. 9 illustrates an exemplary beveling fixture useful for forming bevel surfaces on skive fingers.

FIG. 9 illustrates an exemplary beveling fixture 430 that can be used to fabricate skive fingers 312 having planar bevel surfaces 340, 341 as shown in FIG. 8A. The skive finger 312 is clamped into the beveling fixture 430 using a clamp 435, with the tip 344 of the skive finger 312 being positioned in contact with the planar surface of a grinding stone 450. The exemplary beveling fixture 430 includes a sweep angle adjustment mechanism 440 which can be adjusted to control the sweep angle $\theta_{S1}$, $\theta_{S2}$ of the bevel surfaces 340, 341, and a bevel angle adjustment mechanism 445 to control the tip angle $\theta_T$ formed by the bevel surfaces 340, 341.

In an exemplary fabrication process, the unbeveled skive finger 312 is clamped into the beveling fixture 430 with the tip 344 just touching the grinding stone 450. An adjustment screw 460 is then adjusted to move the skive finger 312 toward the grinding stone 450 by an amount corresponding to the amount of material that is to be removed by the beveling process. In an exemplary configuration, the beveling process removes between 0.5-1.0 mm of material. the grinding stone 450 is then oscillated back and forth in a motion direction 455 until the desired amount of material is removed. In an exemplary process the grinding stone 450 is moved manually by a human operator. In other configurations a motorized transport system can be used to move the grinding stone 450 using an automated motion process.

After the first bevel surface 340 is formed, the skive finger 312 can be repositioned to form the second bevel surface 341 by making an appropriate adjustment to the sweep angle adjustment mechanism 440.

In other embodiments, the grinding stone 450 in FIG. 9 can be replaced with a grinding wheel or a belt sander. In the case of a belt sander configuration, the tip 344 of the skive finger 312 is positioned against the sanding belt. Rather than moving the grinding stone 450 back and forth in an oscillating motion, the sanding belt is transported along a belt path.

In the embodiments described so far, a point on the second surface 356 of the skive finger 312 corresponding to the intersection of the second surface 356 with the first and second bevel surfaces 340, 341 contacts the pressure roller 64. An important feature of the skive finger 312 is that the sharp edge 342 at the tip 344 of the skive finger 312 is spaced apart from the surface of the pressure roller 64 by a specified tip gap $T_G$. In the preceding embodiments, the tip gap is primarily controlled by controlling the tip angle $9\theta_T$ and the attack angle $\theta_A$. Another feature is that first and second bevel surfaces 340, 341 help direct the flow of the release agent 331 on the surface of the roller so that it doesn't flow up onto the upper surface of the skive fingers 312. In other embodiments these features can be provided using alternate means.

Figure 10A:
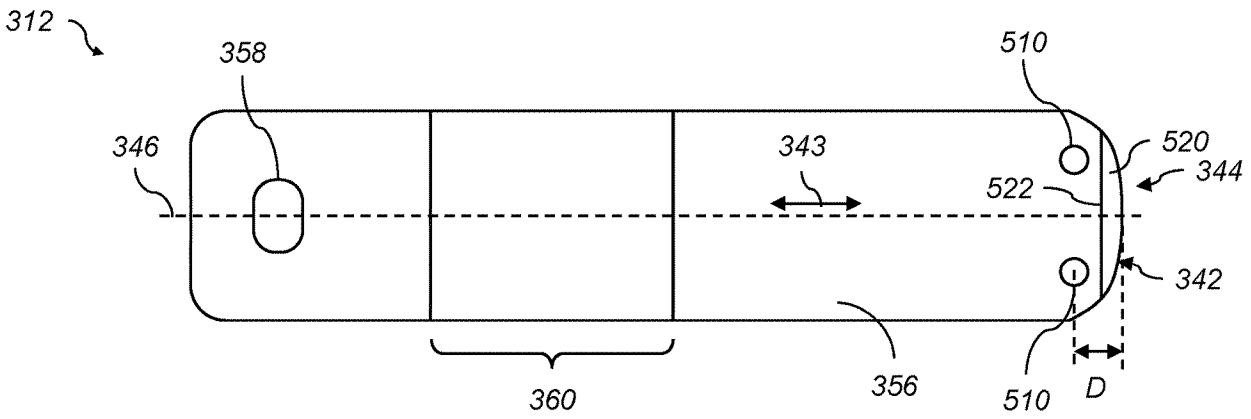
FIGS. 10A-10B illustrate bottom views of exemplary skive fingers in accordance with a second configuration.
Figure 10B:
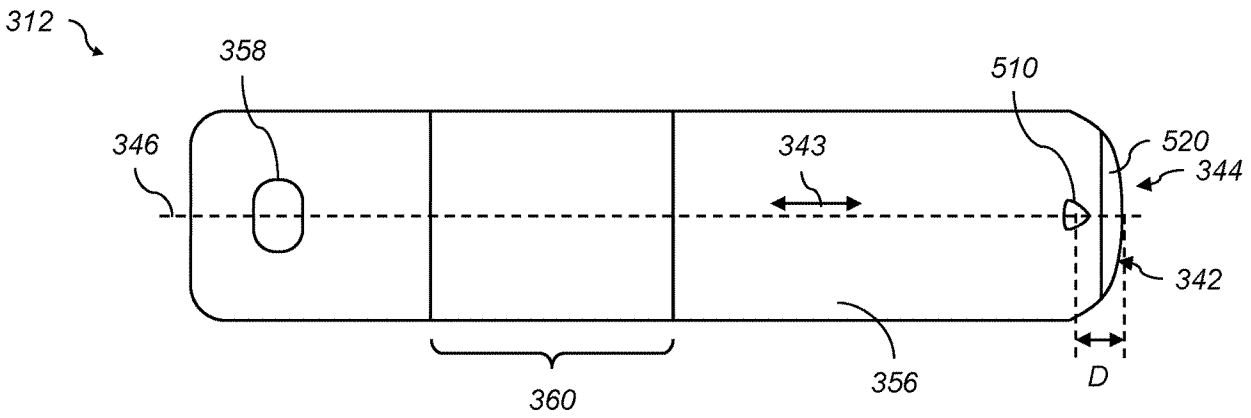
Figure 11:
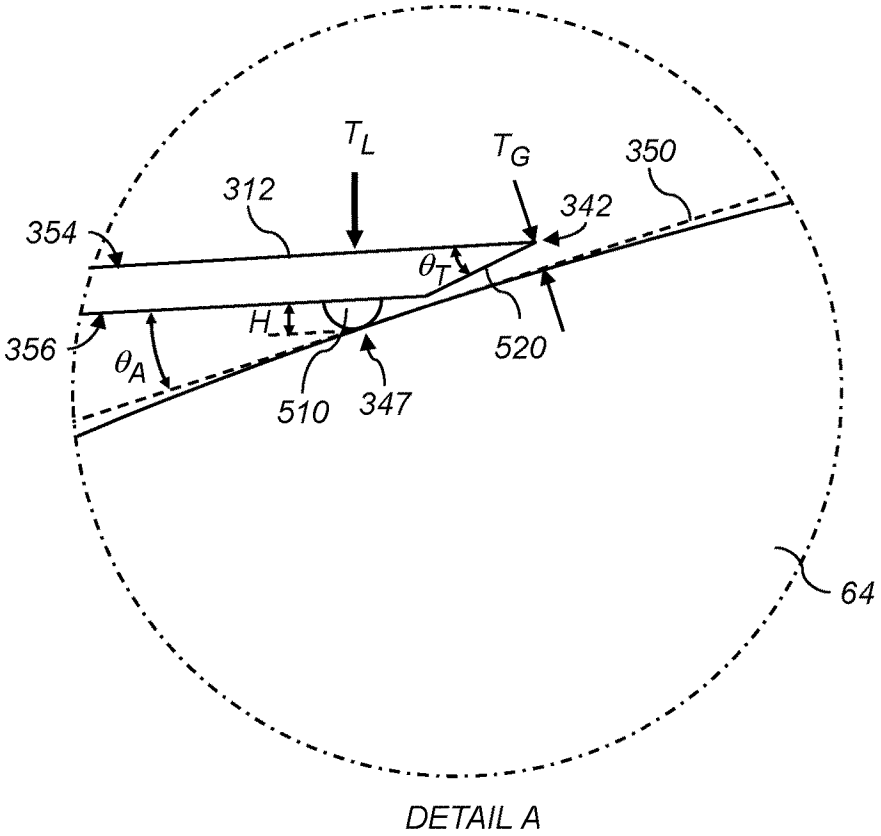
FIG. 11 is a cross-sectional side view of the skive finger of FIG. 10A in operational position relative to a fuser module pressure roller.

One such class of alternate embodiments is illustrated in FIGS. 10A-10B, 11. One or more bumps 510 are provided which are spaced apart from the tip 344 of the skive finger 312 by a distance D. The tip gap $T_G$ is controlled by the distance D together with the height H of the bump(s) 510. Preferably, the tip gap $T_G$ is between 50-120 μm, and more preferably is between 50-100 μm. In the exemplary configuration of FIG. 10A, two bumps 510 are provided on either side of the center line 346. In the exemplary configuration of FIG. 10B, a single bump 510 is provided which is positioned on the centerline. The small contact points 347 between the surface of the pressure roller 64 and the bumps 510 on the skive finger 312 enables the release agent 331 to flow around the bumps 510 and prevents the release agent 331 from flowing up onto the first surface 354 of the skive finger 312 where it could be transferred to the receiver 42. Preferably the distance D is in the range of 3-8 mm, and the height In the examples of FIGS. 10A-10B, a single bevel surface 520 is provided which forms a sharp edge 342 at the tip 344 of the skive finger 312. An intersection line 522 formed between the bevel surface and the second surface 356 of the skive finger 312 is perpendicular to the centerline 346 extending in the length direction 343. The tip angle $\theta_T$ is preferably less than 25 degrees, and more preferably less than 15 degrees. In other embodiments, multiple bevel surfaces (e.g., the first and second bevel surfaces 340, 341 of FIG. 4) can be used in combination with the bumps 510 of FIGS. 10A-10B.

Figure 12A:
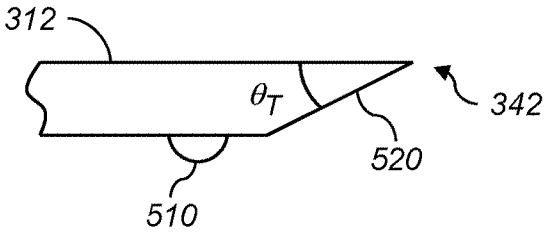
FIGS. 12A-12C illustrate a number of exemplary bump geometries for the skive fingers of FIGS. 10A-10B.
Figure 12B:
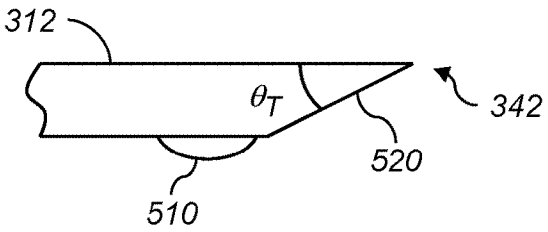
Figure 12C:
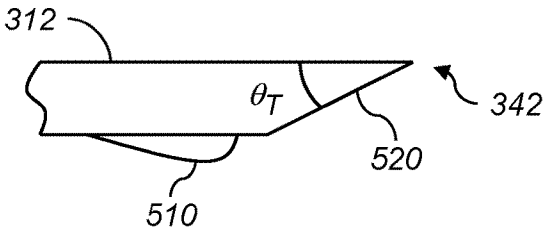

The bumps 510 can have a variety of different shapes. For example, FIG. 10A illustrates bumps 510 with a circular footprint, whereas FIG. 10B illustrates a bump with a rounded triangle footprint. Likewise, the height profiles of the bumps 510 can also take a variety of shapes as illustrated by some exemplary shapes in FIGS. 12A-12C. In the example of FIG. 12A, the bump 510 has a hemispherical profile. In the example of FIG. 12B, the height profile of the bump 510 is elliptical. In the example of FIG. 12C, the bump 510 has an asymmetric height profile.

The bumps 510 can be fabricated using any appropriate means known in the art. In some embodiments, the bumps can be formed by using a punching operation to locally deform the shape of the skive finger 312. In other embodiments, the skive fingers 312 including the bumps 510 can be formed using a molding operation. In other embodiments, the bumps 510 can be formed by starting with a thicker skive finger 312 and using an etching process to reduce the thickness in the surrounding area leaving the protruding bumps 510.

Figure 13:
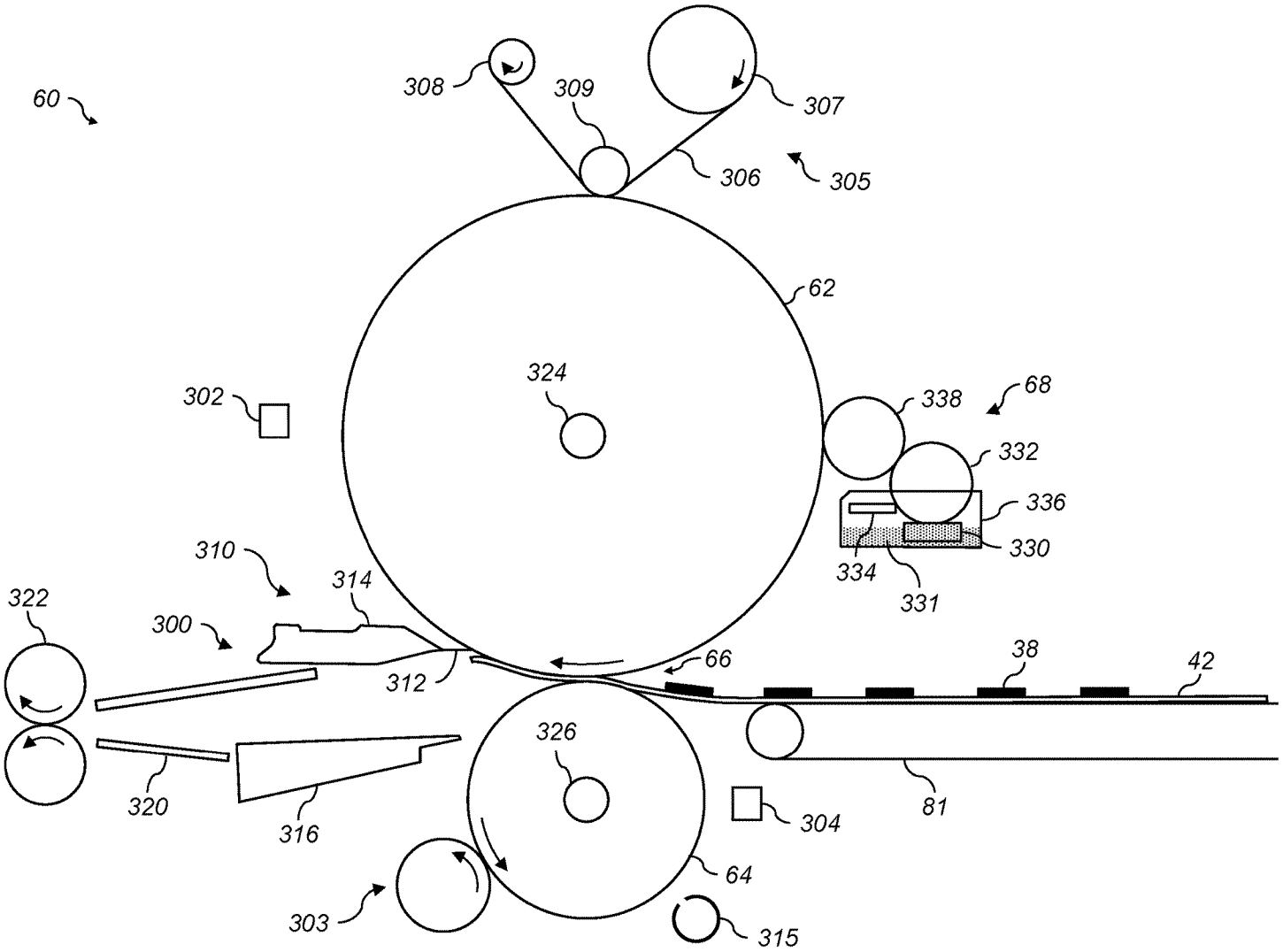
FIG. 13 illustrates a schematic side view of a fuser module in accordance with an alternate embodiment.

In the exemplary embodiments discussed above, the skive finger(s) 312 are used to strip the receiver 42 away from the pressure roller 64 in the fuser module 60. It will be obvious to one skilled in the art that in other embodiments the skive finger(s) 312 can be used to strip the receiver 42 away from the fuser roller 62. In such cases, the skive assembly 310 is inverted and positioned such that the skive finger(s) 312 contact the surface of the fuser roller 62 as illustrated in FIG. 13. The skive finger(s) 312 of the present invention can also be used in other types of paper transport systems to strip a sheet of receiver medium away from the surface of any type of roller such as a paper transport roller.

The invention has been described in detail with particular reference to certain preferred embodiments thereof, but it will be understood that variations, combinations, and modifications can be effected by a person of ordinary skill in the art within the spirit and scope of the invention.

PARTS LIST

31 printing module
32 printing module
33 printing module
34 printing module
printing module
38 print image
39 fused image
supply unit
42 receiver
42*a* receiver
42*b* receiver
50 transfer subsystem
60 fuser module
62 fusing roller
64 pressure roller
66 fusing nip
68 release agent application substation
69 output tray
70 finisher
81 transport web
86 cleaning station
99 logic and control unit
100 printer
111 imaging member
112 intermediate transfer member
113 transfer backup member
201 first transfer nip
202 second transfer nip
206 photoreceptor
210 charging subsystem
211 meter
212 meter
213 grid
216 surface

220 exposure subsystem
225 development subsystem
226 toning shell
227 magnetic core
240 power source
300 stripping mechanism
302 fusing roller temperature sensor
304 pressure roller temperature sensor
303 pressure roller cleaner
305 fusing roller cleaner assembly
306 cleaning web
307 supply roll
308 take-up roll
309 web back-up roller
310 skive assembly
312 skive finger
314 mounting mechanism
315 pressure roller cooler
316 air skive
320 paper guides
322 exit rollers
324 heater lamp
326 heater lamp
330 wick pad
331 release agent
332 metering roller
334 metering blade
336 release agent reservoir
338 donor roller
340 bevel surface
341 bevel surface
342 sharp edge
343 length direction
344 tip
346 center line
347 contact point
348 intersection line
349 intersection line
350 tangent line
354 first surface
356 second surface
358 mounting hole
360 thinned portion
400 skive bracket
405 mounting pin
410 skive hold-down
415 hold-down spring
420 hold-down pivot pin
425 wing
430 beveling fixture
435 clamp
440 sweep angle adjustment mechanism
445 bevel angle adjustment mechanism
450 grinding stone
455 motion direction
460 adjustment screw
510 bump
520 bevel surface
522 intersection line
D distance
H height
$T_G$ tip gap
$T_L$ tip load
$T_O$ tip offset
$\theta_{S1}$ sweep angle
$\theta_{S2}$ sweep angle
$\theta_T$ tip angle
$\theta_A$ attack angle

The invention claimed is:

1. A fuser apparatus including:

first and second rollers in nip relation to transport a receiver member therebetween and to permanently fuse marking particles to the receiver member under application of heat and pressure; and a stripping mechanism for stripping the receiver member from the first roller, the stripping mechanism including one or more skive assemblies, each skive assembly including:

an elongated, thin, flexible skive finger having a first surface, a second surface, and at least one raised bump protruding from the second surface spaced apart from a tip of the skive finger, wherein the tip of the skive finger is beveled with at least one bevel surface forming a sharp edge along the first surface having a tip angle of less than 25 degrees; and a mounting mechanism for positioning the skive finger in operative relation to the first roller such that the at least one raised bump protruding from the second surface of the skive finger contacts a surface of the first roller at a contact point such that the sharp edge along the first surface of the skive finger is spaced apart from the surface of the first roller by a distance of between 50 and 120 microns;

wherein a difference between the tip angle and an attack angle formed between the second surface of the skive finger and a tangent plane to the first roller at the contact point is between 5 and 15 degrees.

2. The fuser apparatus of claim 1, wherein the first roller is a backing roller and the second roller is a heated fuser roller.

3. The fuser apparatus of claim 1, wherein the first roller is a heated fuser roller and the second roller is a backing roller.

4. The fuser apparatus of claim 1, further including a release agent management system that applies a release agent to the first or second roller.

5. The fuser apparatus of claim 4, wherein the mounting mechanism positions the skive finger such that release agent on the surface of the first roller does not flow onto the first surface of the skive finger as the first roller is rotated.

6. The fuser apparatus of claim 1, wherein the skive finger has a centerline extending in a length direction, wherein the skive finger is beveled with first and second bevel surfaces, wherein the first bevel surface bevels the tip on a first side of the centerline and the second bevel surface bevels the tip on a second side of the centerline, wherein a first intersection line between the first bevel surface and the second surface is oriented at a first sweep angle relative to a line normal to the centerline and a second intersection line between the second bevel surface and the second surface is oriented at a second sweep angle relative to the line normal to the centerline, the first and second sweep angles having magnitudes between 5 and 30 degrees.

7. The fuser apparatus of claim 1, wherein the at least one bevel surface is a flat surface.

8. The fuser apparatus of claim 1, wherein the at least one bevel surface is a non-planar surface.

9. The fuser apparatus of claim 8, wherein the at least one bevel surface has a stepped thickness profile.

10. A paper transport system including:

first and second rollers in nip relation to transport a receiver member therebetween; and a stripping mechanism for stripping the receiver member from the first roller, the stripping mechanism including one or more skive assemblies, each skive assembly including:

an elongated, thin, flexible skive finger having a first surface, a second surface, and at least one raised bump protruding from the second surface spaced apart from a tip of the skive finger, wherein the tip of the skive finger is beveled with at least one bevel surface forming a sharp edge along the first surface having a tip angle of less than 25 degrees; and a mounting mechanism for positioning the skive finger in operative relation to the first roller such that the at least one raised bump protruding from the second surface of the skive finger contacts a surface of the first roller at a contact point such that the sharp edge along the first surface of the skive finger is spaced apart from the surface of the first roller by a distance of between 50 and 120 microns;

wherein a difference between the tip angle and an attack angle formed between the second surface of the skive finger and a tangent plane to the first roller at the contact point is between 5 and 15 degrees.

11. A fuser apparatus including:

first and second rollers in nip relation to transport a receiver member therebetween and to permanently fuse marking particles to the receiver member under application of heat and pressure; and a stripping mechanism for stripping the receiver member from the first roller, the stripping mechanism including one or more skive assemblies, each skive assembly including:

an elongated, thin, flexible skive finger having a first surface, a second surface, and at least one raised bump protruding from the second surface spaced apart from a tip of the skive finger, wherein the tip of the skive finger is beveled with at least one bevel surface forming a sharp edge along the first surface having a tip angle of less than 25 degrees; and a mounting mechanism for positioning the skive finger in operative relation to the first roller such that the at least one raised bump protruding from the second surface of the skive finger contacts a surface of the first roller at a contact point such that the sharp edge along the first surface of the skive finger is spaced apart from the surface of the first roller by a distance of between 50 and 120 microns;

wherein the skive finger has a centerline extending in a length direction, wherein the skive finger is beveled with first and second bevel surfaces, wherein the first bevel surface bevels the tip on a first side of the centerline and the second bevel surface bevels the tip on a second side of the centerline, wherein a first intersection line between the first bevel surface and the second surface is oriented at a first sweep angle relative to a line normal to the centerline and a second intersection line between the second bevel surface and the second surface is oriented at a second sweep angle relative to the line normal to the centerline, the first and second sweep angles having magnitudes between 5 and 30 degrees.

* * * * *